US010458409B2

(12) United States Patent
Su et al.

(10) Patent No.: US 10,458,409 B2
(45) Date of Patent: Oct. 29, 2019

(54) COMPRESSOR HAVING A SLEEVE GUIDE ASSEMBLY

(71) Applicant: Emerson Climate Technologies, Inc., Sidney, OH (US)

(72) Inventors: Xiaogeng Su, Baelen (BE); Srinivasan Ramalingam, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 158 days.

(21) Appl. No.: 15/597,425

(22) Filed: May 17, 2017

(65) Prior Publication Data

US 2017/0350396 A1 Dec. 7, 2017

Related U.S. Application Data

(60) Provisional application No. 62/346,134, filed on Jun. 6, 2016.

(51) Int. Cl.
*F04C 29/00* (2006.01)
*F04C 18/02* (2006.01)
(Continued)

(52) U.S. Cl.
CPC ..... *F04C 29/0021* (2013.01); *F04C 18/0215* (2013.01); *F04C 27/005* (2013.01);
(Continued)

(58) Field of Classification Search
CPC ..... F04C 18/0207; F04C 18/0215; F04C 27/005; F04C 29/0021; F04C 18/0246
See application file for complete search history.

(56) References Cited

U.S. PATENT DOCUMENTS 5,580,230 A 12/1996 Keifer et al.
6,027,321 A 2/2000 Shim et al.
(Continued)

FOREIGN PATENT DOCUMENTS

CN 1740571 A 3/2006
CN 103225610 A 7/2013
(Continued)

OTHER PUBLICATIONS

Search Report regarding European Patent Application No. 17174356.0, dated Oct. 24, 2017.
(Continued)

*Primary Examiner* — Deming Wan
(74) *Attorney, Agent, or Firm* — Harness, Dickey & Pierce, P.L.C.

(57) ABSTRACT

A compressor may include a shell, a bearing housing, an orbiting scroll, and a non-orbiting scroll. The bearing housing is supported within the shell and includes a central body and a plurality of arms. Each arm extends radially outwardly from the central body and has a first aperture. The orbiting scroll is supported on the bearing housing. The non-orbiting scroll is meshingly engaged with the orbiting scroll and includes a plurality of second apertures. Each second aperture receives a plurality of bushings and a fastener. The fastener extends through the bushings and into a corresponding one of the first apertures in the bearing housing to rotatably secure the non-orbiting scroll relative to the bearing housing while allowing relative axial movement between the non-orbiting scroll and the bearing housing.

23 Claims, 4 Drawing Sheets

(51) Int. Cl.
*F04C 27/00* (2006.01)
*F04C 29/06* (2006.01)

(52) U.S. Cl.
CPC ..... *F04C 29/06* (2013.01); *F04C 2240/30* (2013.01); *F04C 2240/56* (2013.01); *F04C 2240/805* (2013.01); *F04C 2270/13* (2013.01)

(56) References Cited

U.S. PATENT DOCUMENTS

| | | | | |
|---|---|---|---|---|
| 6,345,966 | B1 | 2/2002 | Hahn et al. | |
| 2005/0201883 | A1 | 9/2005 | Clendenin et al. | |
| 2006/0198748 | A1* | 9/2006 | Grassbaugh ..... | F04C 18/0215 418/55.6 |
| 2007/0059192 | A1* | 3/2007 | Stover ..... | F04C 18/0215 418/55.1 |
| 2013/0287617 | A1 | 10/2013 | Siefring | |

FOREIGN PATENT DOCUMENTS

| | | | |
|---|---|---|---|
| CN | 207145228 | U | 3/2018 |
| EP | 1577558 | A2 | 9/2005 |
| JP | H02277995 | A | 11/1990 |
| JP | H0932752 | A | 2/1997 |
| JP | H1061568 | A | 3/1998 |
| JP | 2002161876 | A | 6/2002 |
| JP | 2010138808 | A | 6/2010 |
| WO | WO-2015081261 | A1 | 6/2015 |

OTHER PUBLICATIONS

Office Action regarding Korean Patent Application No. 10-2017-0069179, dated Jul. 16, 2018. Translation provided by KS KORYO International IP Law Firm.
International Search Report regarding Application No. PCT/US2013/038822, dated Aug. 12, 2013.
Written Opinion of the International Searching Authority regarding Application No. PCT/US2013/038822, dated Aug. 12, 2013.
Non-Final Office Action regarding U.S. Appl. No. 13/856,891, dated Sep. 12, 2014.
U.S. Office Action regarding U.S. Appl. No. 13/856,891, dated Feb. 26, 2015.
Interview Summary regarding U.S. Appl. No. 13/856,891, dated Apr. 6, 2015.
Advisory Action regarding U.S. Appl. No. 13/856,891, dated May 7, 2015.
Office Action regarding U.S. Appl. No. 13/856,891, dated Aug. 24, 2015.
Office Action regarding Chinese Patent Application No. 201380022652.9, dated Nov. 4, 2015. Translation provided by Unitalen Attorneys at Law.
Office Action regarding U.S. Appl. No. 13/856,891, dated Feb. 8, 2016.
Office Action regarding Chinese Patent Application No. 201380022652.9, dated Jun. 29, 2016. Translation provided by Unitalen Attorneys at Law.
Office Action regarding Chinese Patent Application No. 201710414659.5, dated Sep. 19, 2018. Translation provided by Unitalen Attorneys at Law.

* cited by examiner

COMPRESSOR HAVING A SLEEVE GUIDE ASSEMBLY

CROSS-REFERENCE TO RELATED APPLICATIONS

This application claims the benefit of U.S. Provisional Application No. 62/346,134, filed on Jun. 6, 2016. The disclosure of the above application is incorporated herein by reference.

FIELD

The present disclosure relates to a compressor having a sleeve guide assembly.

BACKGROUND

This section provides background information related to the present disclosure and is not necessarily prior art.

A compressor may include fasteners and sleeve guides that allow for axial movement or compliance of a non-orbiting scroll relative to a bearing housing to which the non-orbiting scroll is mounted. Clearance between the sleeve guides and the non-orbiting scroll and clearance between the sleeve guides and the fasteners allows for relative movement (e.g., vibration) between non-orbiting scroll and the sleeve guides during operation of the compressor. Such vibration produces undesirable noise. The present disclose provides sleeve guide assemblies that may reduce or restrict the movement and vibration of the non-orbiting scroll relative to the sleeve guide assemblies, which significantly reduces noise produced during operation of the compressor.

SUMMARY

This section provides a general summary of the disclosure, and is not a comprehensive disclosure of its full scope or all of its features.

In one form, a compressor may include a shell, a bearing housing, an orbiting scroll, and a non-orbiting scroll. The bearing housing is supported within the shell and includes a central body and a plurality of arms. Each arm extends radially outwardly from the central body and has a first aperture. The orbiting scroll is supported on the bearing housing. The non-orbiting scroll is meshingly engaged with the orbiting scroll and includes a plurality of second apertures. Each second aperture receives a plurality of bushings and a fastener. The fastener extends through the bushings and into a corresponding one of the first apertures in the bearing housing to rotatably secure the non-orbiting scroll relative to the bearing housing while allowing relative axial movement between the non-orbiting scroll and the bearing housing.

In some configurations, one of the plurality of bushings inside each second aperture extends axially out of the second aperture and abuts a corresponding arm of the bearing housing.

In some configurations, another one of the plurality of bushings inside each second aperture extends axially out of the flange aperture and axially separates a head of the fastener from a flange of the non-orbiting scroll.

In some configurations, one of the plurality of bushings is axially longer than another of the plurality of bushings.

In some configurations, a first bushing of the plurality of bushings is radially misaligned with a second bushing of the plurality of bushings and is radially misaligned with a corresponding second aperture.

In some configurations, each of the second apertures receives two bushings.

In some configurations, the fasteners threadably engage the first apertures.

In some configurations, the compressor includes a floating seal assembly cooperating with the non-orbiting scroll to define a biasing chamber containing intermediate-pressure fluid axially biasing the non-orbiting scroll toward the orbiting scroll.

In some configurations, the non-orbiting scroll includes a flange through which at least one of the second apertures extends.

In some configurations, the non-orbiting scroll includes a plurality of radially outwardly extending portions, and wherein each of the second apertures extends through a respective one of the radially outwardly extending portions.

In another form, a compressor may include a shell, a bearing housing, a non-orbiting, an orbiting scroll, a plurality of bushings, and a plurality of fasteners. The bearing housing is fixed within the shell and includes a central body and a plurality of arms. The arms extend radially outwardly from the central body and have first apertures. The non-orbiting scroll includes a plurality of second apertures. The orbiting scroll is supported on the bearing housing and meshingly engaged with the non-orbiting scroll. Each bushing has a third aperture. Each second aperture in the non-orbiting scroll receives at least two of the bushings. The fasteners rotatably secure the non-orbiting scroll relative to the bearing housing. Each fastener extends through the third apertures of the at least two of the bushings and are received in a corresponding one of the first apertures in the bearing housing.

In some configurations, one of the at least two of the bushings inside each second aperture extends axially out of the second aperture and abuts a corresponding arm of the bearing housing.

In some configurations, another one of the at least two of the bushings inside each second aperture extends axially out of the second aperture and axially separates a head of the fastener from a flange of the non-orbiting scroll.

In some configurations, one of the at least two of the bushings is axially longer than another of the at least two of the bushings.

In some configurations, a first bushing of the plurality of bushings is radially misaligned with a second bushing of the plurality of bushings and is radially misaligned with a corresponding second aperture.

In some configurations, each of the second apertures receives only two bushings.

In some configurations, wherein the fasteners threadably engage the first apertures.

In some configurations, the compressor includes a floating seal assembly cooperating with the non-orbiting scroll to define a biasing chamber containing intermediate-pressure fluid axially biasing the non-orbiting scroll toward the orbiting scroll.

In some configurations, the non-orbiting scroll includes a flange through which at least one of the second apertures extends.

In some configurations, the non-orbiting scroll includes a plurality of radially outwardly extending portions, and wherein each of the second apertures extends through a respective one of the radially outwardly extending portions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
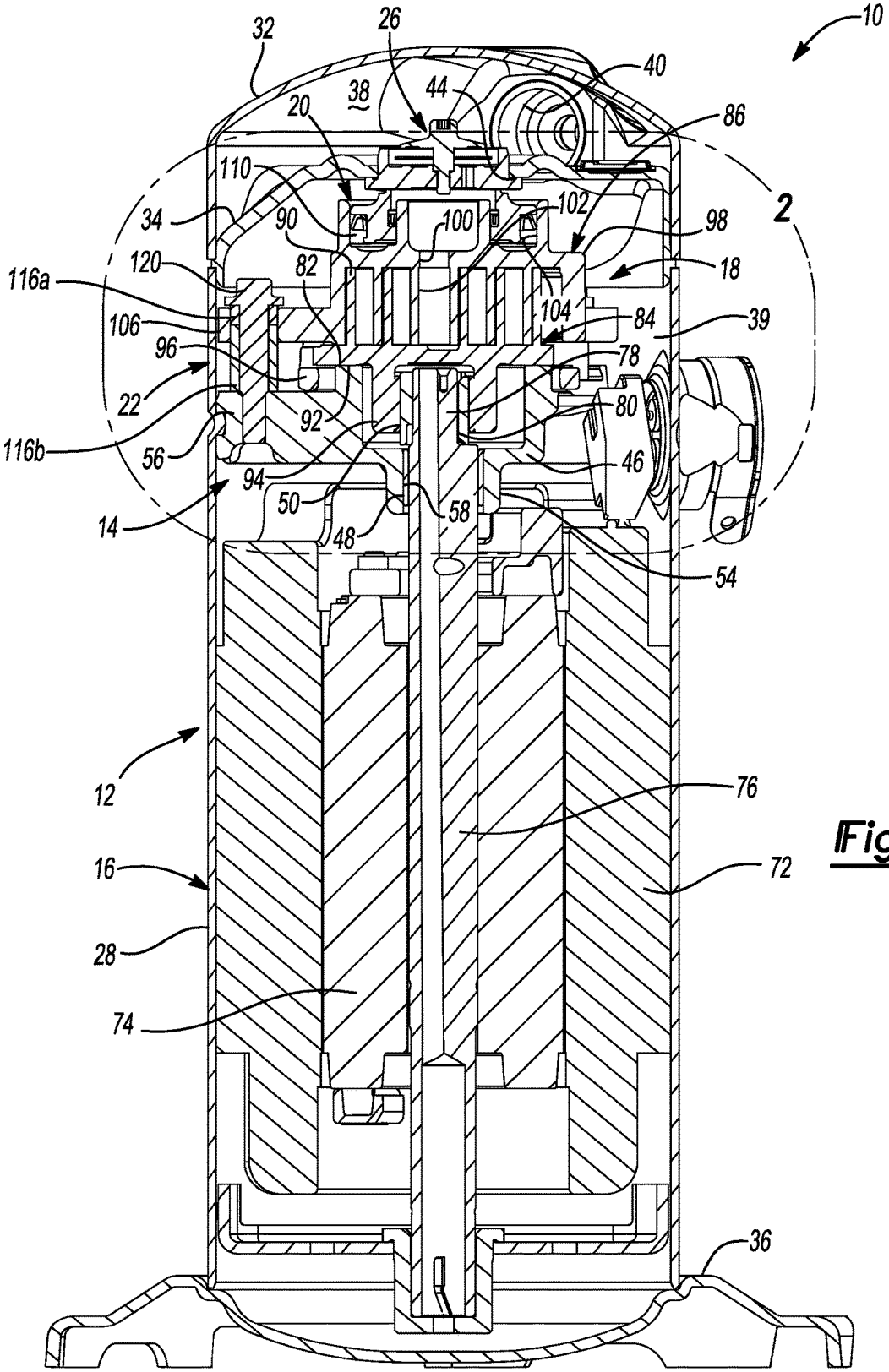
FIG. 1 is a cross-sectional view of a compressor having sleeve guide assemblies according to the principles of the present disclosure.

The principles of the present disclosure are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and at least a portion of the compression mechanism are disposed in a suction-pressure region of the compressor, as illustrated in FIG. 1. It will be appreciated that the principles of the present disclosure are also applicable to high-side compressors (i.e., compressors having the motor and compression mechanism disposed in a discharge-pressure region of the compressor).

With reference to FIGS. 1-4, the compressor 10 may include a shell assembly 12, a bearing housing assembly 14, a motor assembly 16, a compression mechanism 18, a seal assembly 20, a plurality of bushing or sleeve guide assemblies 22, and a discharge valve assembly 26. The shell assembly 12 may house the bearing housing assembly 14, the motor assembly 16, the compression mechanism 18, the seal assembly 20, the plurality of bushing assemblies 22, and the discharge valve assembly 26.

The shell assembly 12 may generally form a compressor housing and may include a cylindrical shell 28, an end cap 32 at the upper end thereof, a transversely extending partition 34, and a base 36 at a lower end thereof. The end cap 32 and the partition 34 may generally define a discharge chamber 38 (i.e., a discharge-pressure region). The discharge chamber 38 may generally form a discharge muffler for the compressor 10. While illustrated as including the discharge chamber 38, it is understood that the present disclosure applies equally to direct discharge configurations. The shell assembly 12 may define an opening 40 in the end cap 32 forming a discharge outlet. The shell assembly 12 may additionally define a suction inlet (not shown) in communication with a suction chamber 39 (i.e., a suction-pressure region). The partition 34 may include a discharge passage 44 therethrough providing communication between the compression mechanism 18 and the discharge chamber 38.

The bearing housing assembly 14 may include a main bearing housing 46, a bearing 48, and a drive bushing 50. The main bearing housing 46 may be fixed to the shell 28 at a plurality of points in any desirable manner, such as staking, for example. The main bearing housing 46 may include a central body 54 with arms 56 extending radially outward from the central body 54. The central body 54 may include a bore defined by a circumferential wall 58 housing the bearing 48. The arms 56 may be engaged with the shell 28 to fixedly support the main bearing housing 46 within the shell 28. Each of the arms 56 may include a first aperture (or arm aperture) 66 extending therethrough.

As shown in FIG. 1, the motor assembly 16 may include a motor stator 72, a rotor 74, and a drive shaft 76. The motor stator 72 may be press fit into the shell 28. The rotor 74 may be press fit on the drive shaft 76 and the drive shaft 76 may be rotationally driven by the rotor 74. The drive shaft 76 may extend through the bore defined by the circumferential wall 58 and may be rotationally supported within the main bearing housing 46 by the bearing 48.

The drive shaft 76 may include an eccentric crank pin 78 having a flat 80 thereon. The drive bushing 50 may be located on the eccentric crank pin 78 and may be engaged with the compression mechanism 18. The main bearing housing 46 may define a thrust bearing surface 82 supporting the compression mechanism 18.

The compression mechanism 18 may include an orbiting scroll 84 and a non-orbiting scroll 86 meshingly engaged with one another. The orbiting scroll 84 may include an end plate 88 having a spiral vane or wrap 90 on the upper surface thereof and an annular flat thrust surface 92 on the lower surface. The thrust surface 92 may interface with the annular flat thrust bearing surface 82 on the main bearing housing 46. A cylindrical hub 94 may project downwardly from the thrust surface 92 and may have the drive bushing 50 rotatably disposed therein. The drive bushing 50 may include an inner bore receiving the crank pin 78. The crank pin flat 80 may drivingly engage a flat surface in a portion of the inner bore of the drive bushing 50 to provide a radially compliant driving arrangement. An Oldham coupling 96 may be engaged with the orbiting and non-orbiting scrolls 84, 86 (or with the orbiting scroll 84 and the main bearing housing 46) to prevent relative rotation between the orbiting and non-orbiting scrolls 84, 86.

The non-orbiting scroll 86 may include an end plate 98 defining a discharge passage 100 and having a spiral wrap 102 extending from a first side thereof, an annular recess 104 defined in a second side thereof opposite the first side, and a plurality of radially outwardly extending flanged portions 106 engaged with the plurality of bushing assemblies 22. The end plate 98 may additionally include a biasing passage (not shown) in fluid communication with the annular recess 104 and an intermediate compression pocket defined by the orbiting and non-orbiting scrolls 84, 86. The seal assembly 20 may form a floating seal assembly and may be sealingly engaged with the non-orbiting scroll 86 to define an axial biasing chamber 110 containing intermediate-pressure working fluid that biases the non-orbiting scroll 86 axially (i.e., in a direction parallel to the rotational axis of the drive shaft 76) toward the orbiting scroll 84. Each of the flanged portions 106 of the non-orbiting scroll 86 may include a second aperture (or flange aperture) 114.

Figure 2:
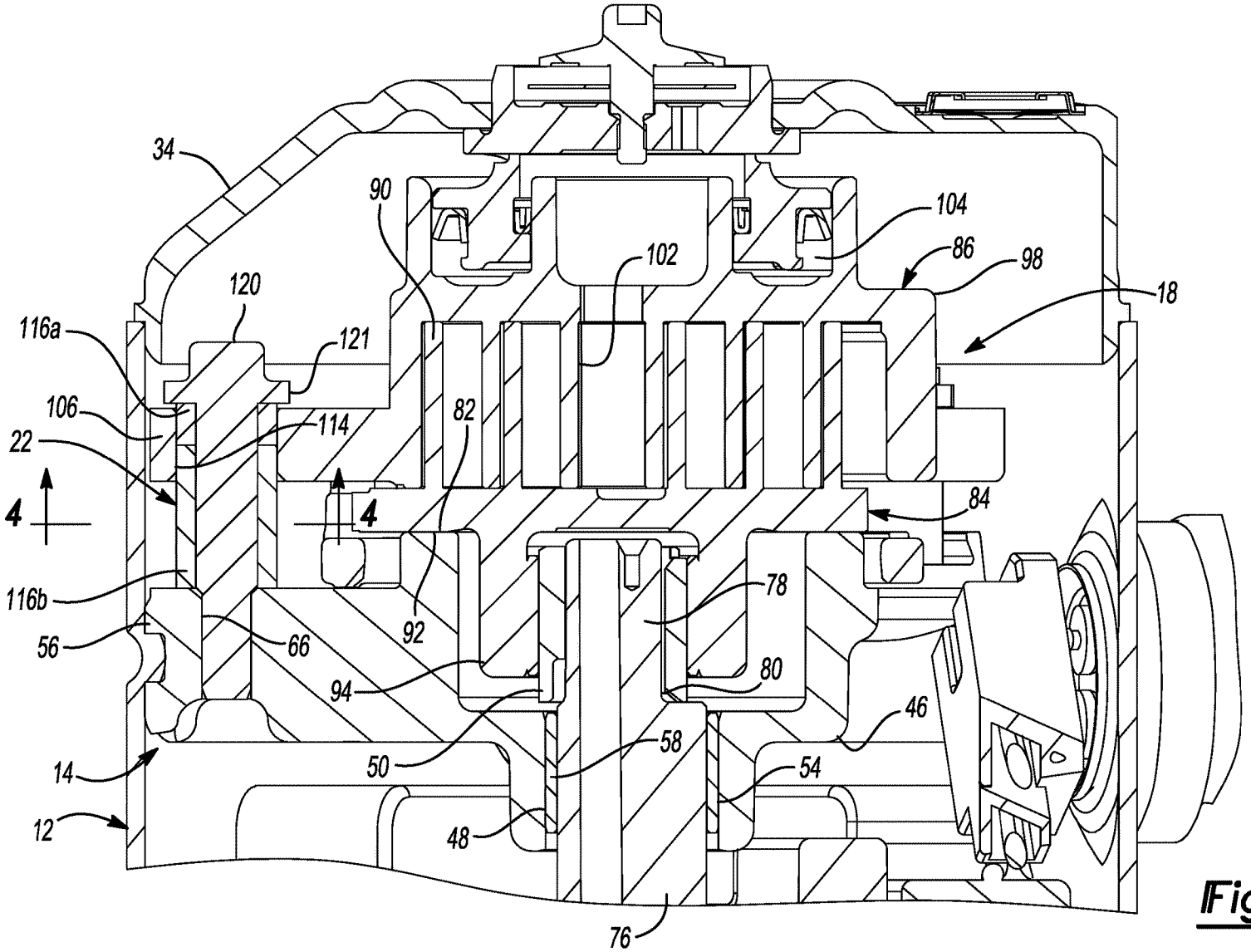
FIG. 2 is a cross-sectional view of a portion of the compressor indicated as area 2 in FIG. 1.
Figure 3:
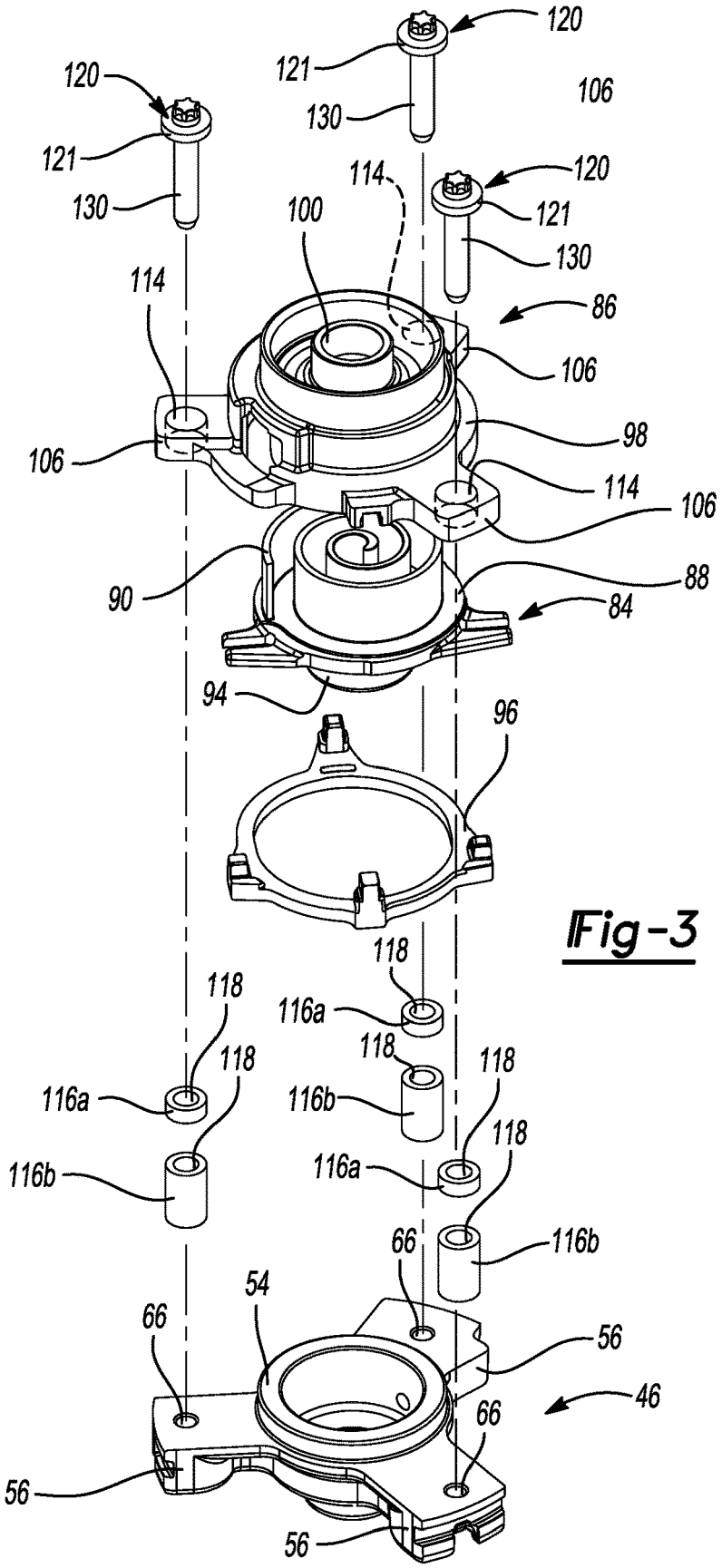
FIG. 3 is an exploded perspective view of a bearing housing, the sleeve guide assemblies and a compression mechanism of the compressor.

The plurality of bushing assemblies 22 may rotationally fix the non-orbiting scroll 86 relative to the main bearing housing 46 while allowing axial displacement of the non-orbiting scroll 86 relative to the main bearing housing 46. Each bushing assembly 22 may include a plurality of bushings (e.g., a first bushing 116*a* and a second bushing 116*b*) and a fastener 120. Each of the bushings 116*a*, 116*b* may include a third aperture (or bushing aperture) 118. Each bushing assembly 22 may be received within a corresponding one of the flange apertures 114 of the non-orbiting scroll 86. That is, each flange aperture 114 receives one of the fasteners 120, one of the first bushings 116*a* and one of the second bushings 116*b*. As shown in FIG. 2, the first bushing 116*a* of each bushing assembly 22 may extend axially out of the corresponding flange aperture 114 and abut a head 121 of the fastener 120 (or a washer) such that the head 121 (or the washer) is slightly axially spaced apart from the arm 56 of the main bearing housing 46, thereby allowing axial movement of the non-orbiting scroll 86 relative to the main bearing housing 46. As shown in FIG. 2, the second bushing 116*b* of each bushing assembly 22 extends axially out of the corresponding flange aperture 114 and abuts against the corresponding arm 56 of the bearing housing 46. Each fastener 120 may extend through the bushing apertures 118 of the corresponding plurality of bushings 116*a*, 116*b* and may threadably engage the corresponding arm aperture 66 in the bearing housing 46 to rotatably secure the non-orbiting scroll 86 relative to the bearing housing 46.

Figure 4:
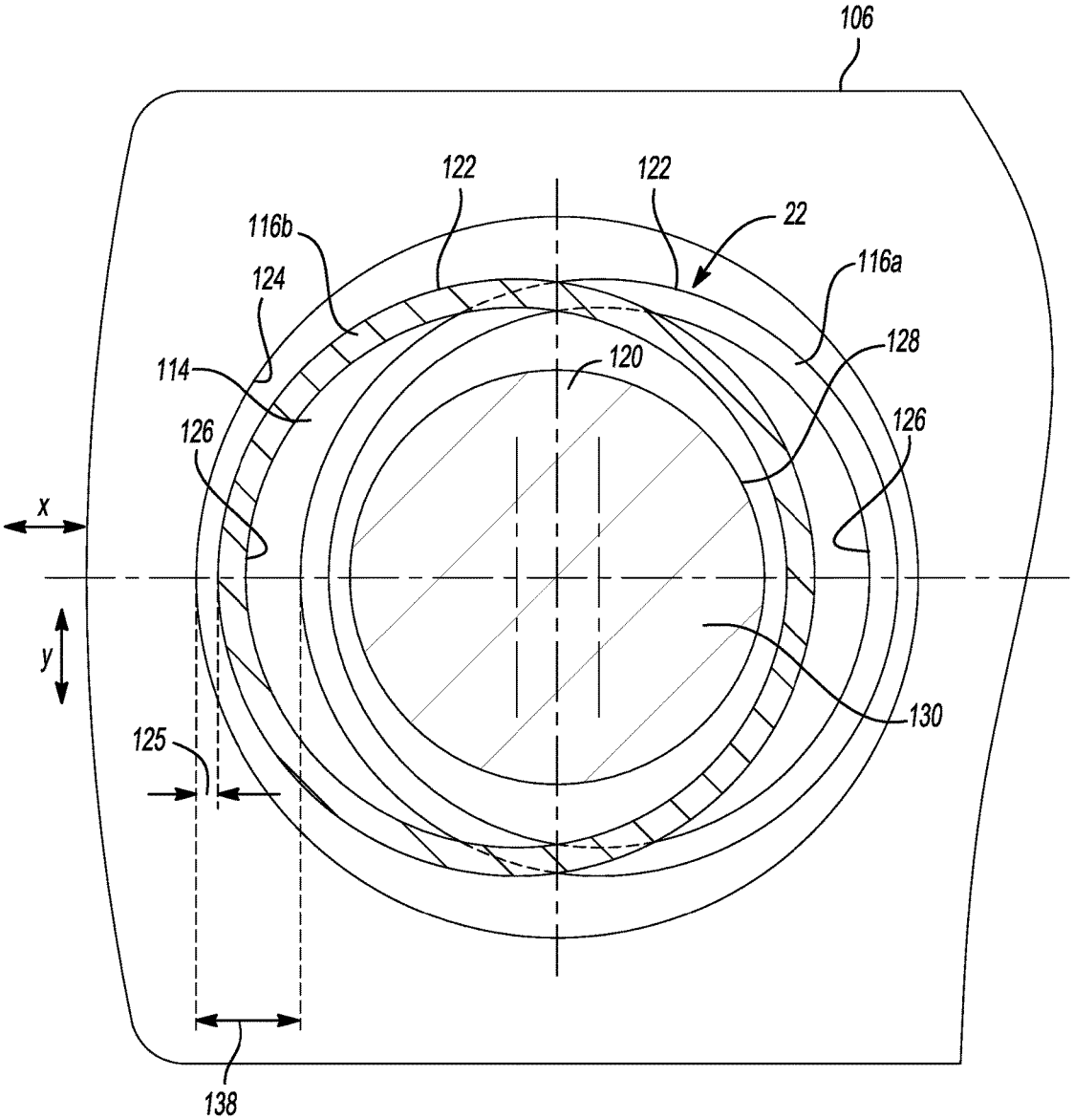
FIG. 4 is a cross-sectional illustration of a portion of the compressor taken along line 4-4 of FIG. 2 and includes a not-to-scale, exaggerated illustration of one of the sleeve guide assemblies received within a non-orbiting scroll.

FIG. 4 is a not-to-scale, exaggerated illustration of one of the bushing assemblies 22 received in a corresponding one of the flange apertures 114. That is, FIG. 4 shows exaggerated clearance gaps between outer diametrical surfaces 122 of the bushings 116*a*, 116*b* and the inner diametrical surface 124 of the flange aperture 114, as well as exaggerated radial misalignment of the bushings 116*a*, 116*a* relative to each other. In some embodiments, the actual clearance gaps and radial misalignment might be only several microns or several thousandths of an inch wide. The clearance gaps and radial misalignment are exaggerated in FIG. 4 to more clearly illustrate concepts described below.

In any given bushing assembly 22 of any given compressor 10 there may be some amount of clearance gaps between the bushings 116*a*, 116*b* and the diametrical surfaces 124, 128, some amount of radial misalignment of the bushings 116*a*, 116*b* relative to each other, and some amount of radial misalignment of the bushings 116*a*, 116*b* relative to the center of the flange aperture 114 in which the bushings 116*a*, 116*b* are received. The locations and sizes of the clearance gaps and the direction and amount of the radial misalignment may vary from assembly to assembly.

In the example shown in FIG. 4, the first bushing 116*a* may be radially misaligned relative to a center point of the flange aperture 114 in one direction, while the second bushing 116*b* may be radially misaligned relative to the center point of the flange aperture 114 in a different direction. It is understood that while FIG. 4 illustrates the second bushing 116*b* radially misaligned relative to the center point of the flange aperture 114 in a direction opposite the first bushing 116*a*, the radially misalignment of the second bushing 116*b* relative to the center point of the flange aperture 114 may be random. The first bushing 116*a* and the flange aperture 114 may define a first clearance gap 125 (i.e., a distance between the inner diametrical surface 124 of the flange aperture 114 and the outer diametrical surface 122 of the first bushing 116*a*). The second bushing 116*b* and the flange aperture 114 may define a second gap 138 (i.e., a distance between the inner diametrical surface 124 of the flange aperture 114 and the outer diametrical surface 122 of the second bushing 116*b*).

A benefit of having the plurality of bushings 116*a*, 116*b* in each flange aperture 114 is that the radial misalignment of the bushings 116*a*, 116*b* relative to each other reduces the effective gaps over which there could be relative movement between the non-orbiting scroll 86 and the bushing assembly 22 (compared to the gap of a bushing assembly with only a single bushing). That is, while the second gap 138 exists between the second bushing 116*b* and the inner diametrical surface 124 of the flange aperture 114 in the X-direction, the first gap 125 between the first bushing 116*a* and the inner diametrical surface 124 of the flange aperture 114 (which is less than the second gap 138) reduces the overall effective gap between the bushing assembly 22 and the inner diametrical surface 124 of the flange aperture 114. In this manner, the radial offset or misalignment between the bushings 116*a*, 116*b* of each bushing assembly 22 reduces the amount of possible relative movement between the non-orbiting scroll 86 and the bushing assemblies 22, which reduces noise and vibration during operation of the compressor 10.

While the gaps 125, 138 are shown in FIG. 4 on one side (the left side) of the center point of the flange aperture 114, similar gaps and effective gaps may also be defined on an opposite side of the center point of the flange aperture 114 in a similar manner (or in directions in addition to or instead of the X-direction), thereby having the same effect in restricting or reducing the relative movement of the plurality of bushings 116 to the non-orbiting scroll 86 as described above.

Compressors having three bushing assemblies 22 with the above-described arrangement (i.e., the plurality of bushings 116 received in each flange aperture 114) were tested and compared to compressors having only a single bushing received in each flange aperture (i.e., one bushing received in each flange aperture) to measure the gap differences in the X-direction. The compressors having only one bushing received in each flange aperture had an average gap in the X-direction of 32 microns (i.e., 32 μm) with a maximum gap measuring 55 microns and a minimum gap measuring 4.8 microns. The compressors having the plurality of bushings 116*a*, 116*b* received in each flange aperture 114 had an average effective gap in the X-direction of 20 microns with a maximum effective gap measuring 44 microns and a minimum effective gap measuring 4.0 microns. Therefore, on average, the effective gaps of the compressors having the plurality of bushings 116*a*, 116*b* in each flange aperture 114 was significantly reduced (e.g., by 37.5% in the tested sample size). Such a reduction of the effective gaps will significantly reduce the average vibration and noise levels of during operation of compressors.

Although the above test results were taken for gap differences in the X-direction, the above-described arrangement also reduces (on average) gaps in other directions (e.g., a Y-direction).

It should be understood that the arrangement described above (i.e., three bushing assemblies 22 per compressor 10) with each flange aperture 114 receiving the bushing assembly 22 having the plurality of bushings 116*a*, 116*b* and the fastener 120 may be applied to compressors having any number of arms 56, flanges 106 and bushing assemblies 22.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shed;

a bearing housing supported within the shell, the bearing housing including a central body and a plurality of arms extending radially outward from the central body, each of the plurality of arms having a first aperture;

an orbiting scroll supported on the bearing housing; and a non-orbiting scrod meshingly engaged with the orbiting scroll and including a plurality of second apertures, each of the plurality of second apertures receiving a plurality of bushings and a fastener, the fastener extending through the plurality of bushings and into a corresponding one of the first apertures in the bearing housing to rotatably secure the non-orbiting scroll relative to the bearing housing while allowing relative axial movement between the non-orbiting scroll and the bearing housing, wherein a first longitudinal axis of a first hushing of the plurality of bushings inside each of the plurality of second apertures is radially misaligned with a second longitudinal axis of a second bushing of the plurality of bushings inside each of the plurality of second apertures.

2. The compressor of claim 1, wherein one of the plurality of bushings inside each of the plurality of second apertures extends axially out of the plurality of second apertures and abuts a corresponding arm of the plurality of arms of the bearing housing.

3. The compressor of claim 2, wherein another one of the plurality of bushings inside each of the plurality of second apertures extends axially out of the plurality of second apertures and axially separates a head of the fastener from a flange of the non-orbiting scroll.

4. The compressor of claim 3, wherein one of the plurality of bushings is axially longer than another of the plurality of bushings.

5. The compressor of claim 1, wherein the first and second longitudinal axes are radially misaligned with a third longitudinal axis of a corresponding one of the plurality of second apertures.

6. The compressor of claim 1, wherein each of the plurality of second apertures receives two bushings.

7. The compressor of claim 1, wherein the fasteners threadably engage the first apertures.

8. The compressor of claim 1, further comprising a floating seal assembly cooperating with the non-orbiting scroll to define a biasing chamber containing intermediate-pressure fluid axially biasing the non-orbiting scroll toward the orbiting scroll.

9. The compressor of claim 1, wherein the non-orbiting scroll includes a flange through which at least one of the plurality of second apertures extends.

10. The compressor of claim 1, wherein the non-orbiting scroll includes a plurality of radially outwardly extending portions, and wherein each of the plurality of second apertures extends through a respective one of the plurality of radially outwardly extending portions.

11. The compressor of claim 1, wherein an axial end of the first bushing of the plurality of bushings inside each of the plurality of second apertures abuts an axial end of the second bushing of the plurality of bushings inside each of the plurality of second aperture such that the first and second bushings of the plurality of bushings inside each of the plurality of second apertures is stacked upon each other.

12. A compressor comprising:

a shell;

a bearing housing fixed within the shell, the bearing housing including a central body and a plurality of arms extending radially outward from the central body, each of the plurality of the arms having a first aperture;

a non-orbiting scroll including a plurality of second apertures;

an orbiting scroll supported on the bearing housing and meshingly engaged with the non-orbiting scroll;

a plurality of bushings each having a third aperture, each of the plurality of second apertures in the non-orbiting scroll receiving at least two of the plurality of bushings; and a plurality of fasteners rotatably securing the non-orbiting scroll relative to the bearing housing, each of the plurality of fasteners extending through the third apertures of the plurality of corresponding bushings and are received in a corresponding one of the first apertures in the bearing housing, wherein an axial end of a first one of the at least two of the plurality of bushings inside each of the plurality of second apertures abuts an axial end of a second one of the at least two of the plurality of bushings inside each of the plurality of second apertures such that the first one of the at least two of the plurality of bushings is stacked upon the second one of the at least two of the plurality of bushings.

13. The compressor of claim 12, wherein one of the at least two of the plurality of bushings inside each of the plurality of second apertures extends axially out of the plurality of the second apertures and abuts a corresponding arm of the plurality of arms of the bearing housing.

14. The compressor of claim 13, wherein another one of the at least two of the plurality of bushings inside each of the plurality of second apertures extends axially out of the plurality of second apertures and axially separates a head of the fastener from a flange of the non-orbiting scroll.

15. The compressor of claim 14, wherein one of the at least two of the plurality of bushings is axially longer than another of the at least two of the plurality of bushings.

16. The compressor of claim 12, wherein a first longitudinal axis of the first one of the at least two of the plurality of bushings inside each of the plurality of second apertures is radially misaligned with a second longitudinal axis of the second one of the at least two of the plurality of bushings inside each of the plurality of second apertures, wherein one of the first and second longitudinal axes of the at least two of the plurality of bushings inside each of the plurality of second apertures is radially misaligned with a third longitudinal axis of a corresponding second aperture of the plurality of second apertures.

17. The compressor of claim 12, wherein each of the plurality of second apertures receives only two of the plurality of bushings.

18. The compressor of claim 12, wherein the fasteners threadably engage the first apertures.

19. The compressor of claim 12, further comprising a floating seal assembly cooperating with the non-orbiting scroll to define a biasing chamber containing intermediate-pressure fluid axially biasing the non-orbiting scroll toward the orbiting scroll.

20. The compressor of claim 12, wherein the non-orbiting scroll includes a flange through which at least one of the plurality of second apertures extends.

21. The compressor of claim 12, wherein the non-orbiting scroll includes a plurality of radially outwardly extending portions, and wherein each of the plurality of second apertures extends through a respective one of the plurality of radially outwardly extending portions.

22. The compressor of claim 12, wherein clearance gaps are defined between the non-orbiting scroll and at least portions of the at least two of the plurality of bushings.

23. The compressor of claim 12, wherein clearance gaps are defined by at least portions of the at least two of the plurality of bushings and at least portions of the fastener received in the third apertures of the at least two bushings.

* * * * *